United States Patent [19]

Kohsiek

[11] Patent Number: 4,812,734

[45] Date of Patent: Mar. 14, 1989

[54] CURRENT-MIRROR ARRANGEMENT

[75] Inventor: Cord H. Kohsiek, Ellerau, Fed. Rep. of Germany

[73] Assignee: U.S. Philips Corp., New York, N.Y.

[21] Appl. No.: 125,262

[22] Filed: Nov. 25, 1987

[30] Foreign Application Priority Data

Dec. 10, 1986 [DE] Fed. Rep. of Germany ..... 3642167

[51] Int. Cl.[4] ..... G05F 3/22

[52] U.S. Cl. ..... 323/312; 323/315

[58] Field of Search ..... 323/311, 312, 314, 315, 323/316; 307/296 R, 297

[56] References Cited

U.S. PATENT DOCUMENTS 3,714,543 1/1973 Sahara et al. ..... 323/315
4,093,907 6/1978 Nutz ..... 323/315
4,119,869 10/1978 Hashimoto ..... 323/315
4,267,519 5/1981 Schade, Jr. ..... 330/255
4,485,313 11/1984 Nagano ..... 323/315

FOREIGN PATENT DOCUMENTS 3139166 8/1982 Fed. Rep. of Germany ..... 323/312

*Primary Examiner*—Peter S. Wong
*Attorney, Agent, or Firm*—Bernard Franzblau

[57] ABSTRACT

A current-mirror arrangement comprising a first branch including two series-connected diodes and a second branch including the series-connected base-emitter paths of two transistors. The ratio between the input and output currents of the current mirror is proportional to the root of the current-gain factor of the transistors.

9 Claims, 1 Drawing Sheet

CURRENT-MIRROR ARRANGEMENT

Figure 1:
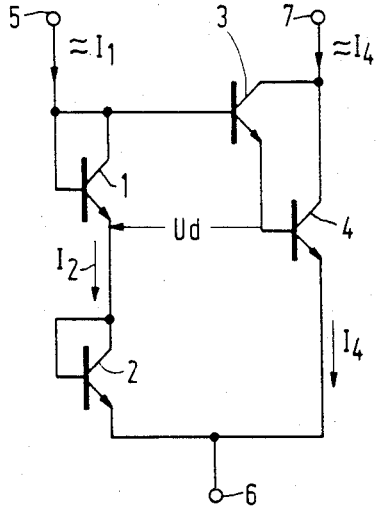

This invention relates to a current-mirror arrangement comprising a first and second branch arranged in parallel with one another. Preferably, such an arrangement forms part of an integrated circuit.

Current-mirror arrangements of this type have been known for a long time. In the first branch they comprise a diode which is generally constituted by a transistor whose collector is connected to its base and in the second branch they comprise the base-emitter junction of a transistor. Current-mirrors of this type supply an output current which is equal to the input current (if the effective emitter areas of the transistors in the two branches are equal to each other), or which is a specific factor larger or smaller than the input current (if the effective emitter area of the transistor in the second branch is scaled up or down by this factor relative to the emitter area of the diode-connected transistor in the first branch). However, in practice the emitter-area ratio is limited to values between approximately 1:10 and 10:1.

It is an object of the present invention to provide a current-mirror which makes it possible to obtain other ratios between the output current and input current.

According to the invention this object is achieved in that the first branch comprises two series-connected diodes and the second branch comprises the series arrangement of the base-emitter paths of two transistors, the emitter current of one transistor constituting the base current of the other transistor.

A special advantage of the arrangement according to the invention is that the ratio between the current in the second branch and the current in the first branch is proportional to the root of the current gain of the one transistor in the second branch whose base current is equal to the emitter current of the other transistor in the second branch. The current gain factor of the transistors of an integrated circuit is basically the same, but the current gain factors of the transistors of two integrated circuits of the same type may differ substantially from each other, in particular if the circuits do not stem from the same wafer. In the case of different circuit types there is a—generally undesired—quiescent current which also fluctuates by the root of the current gain factor of the inverse of this root.

In this respect it is to be noted that from FIG. 3 of U.S. Pat. No. 4,267,519 (5/12/81) a non-linear current amplifier is known, which in a first branch comprises the series arrangement of two diodes and in a parallel second branch comprises the base-emitter path of a first transistor which is arranged in series with a parallel arrangement of a current source and the base-emitter path of a second transistor. In this known circuit arrangement the output current is the square of the input current, whereas in accordance with the invention the input current and the output current are in a constant ratio to each other.

A further embodiment of the current-mirror arrangement in accordance with the invention is characterized in that it is used to compensate for the quiescent current in an integrated circuit, which current is proportional to the root of the current-gain factor of the transistors of a circuit or to the inverse of this root.

Figure 2:
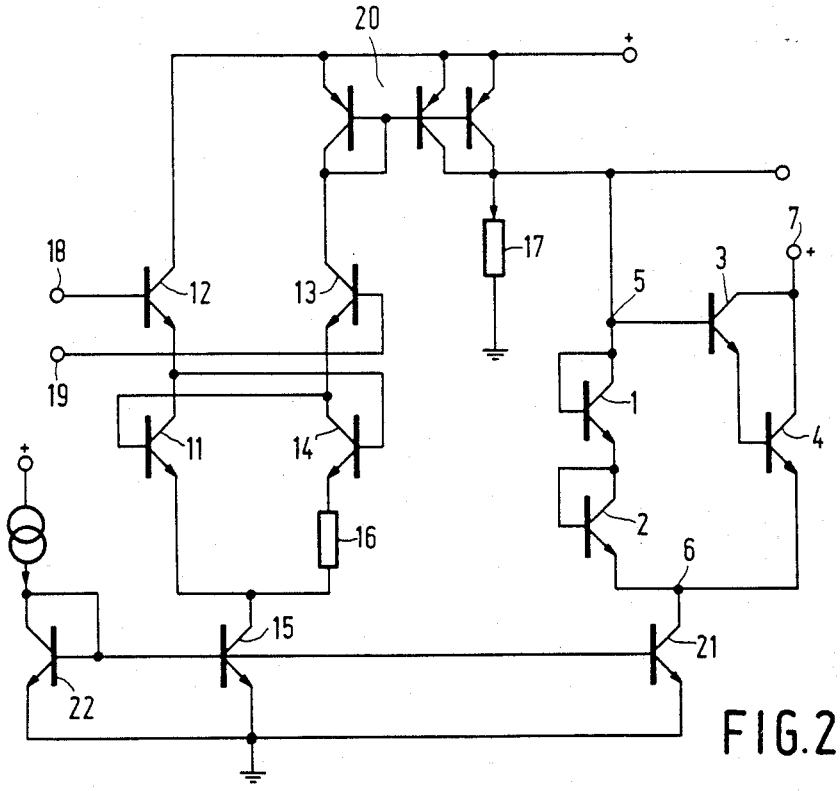

Embodiments of the invention will now be described in more detail, by way of example, with reference to the accompanying drawings. In the drawing:

FIG. 1 is a circuit diagram of the arrangement in accordance with the invention; and FIG. 2 illustrates how the arrangement is used to compensate for the quiescent current in an AM demodulator.

A first branch of the current-mirror arrangement shown in FIG. 1 comprises two series-connected diodes poled in the same direction, which diodes comprise npn-transistors 1 and 2 whose collector-base terminals are each short-circuited.

The second branch comprises two npn-transistors 3 and 4, whose series-connected base-emitter paths are arranged in parallel with the series-connected diodes 1,2. The base of the transistor 3 is connected to the collector-base terminal of the transistor. This junction point constitutes a connection terminal 5 of the current-mirror arrangement. Further, the emitter of the transistor 3 is connected to the base of the transistor 4, whose emitter is connected to the emitter of the transistor 2. The junction point between the emitters of the transistors 2 and 4 constitutes a further connection terminal 6 of the arrangement.

The third connection terminal of the current-mirror is constituted by the collector of the transistor 4, which is connected to the collector of the transistor 3. Since the collector current of the transistor 3 is substantially smaller than the collector current of the transistor 4, the last-mentioned connection may be dispensed with.

For the following calculation it is assumed that the four transistors 1 to 4 have the same characteristics. The emitter current $I_4$ of the transistor 4 is equal to the emitter current of the transistor 3 multiplied by the current gain factor B of said transistor 4. On account of the exponential relationship between the base-emitter voltage and the emitter current of a transistor the following equation is valid:

$$U_4 - U_3 = U_T \ln B \tag{1}$$

Here $U_3$ and $U_4$ are the base-emitter voltages of the transistors 3 and 4 respectively and $U_T$ is the thermal voltage which is approximately 25.5 mV at room temperature. Furthermore, the equation:

$$U_3 = U_1 - U_d \tag{2}$$

is valid, where $U_1$ is the base-emitter voltage of the diode-connected transistor 1 and $U_d$ is the voltage between the emitter of the transistor 3 and the emitter of the transistor 1. Similarly:

$$U_4 = U_2 + U_d \tag{3}$$

where $U_2$ is the base-emitter voltage of the transistor 2. Since the diode-connected transistors 1 and 2 carry the same current, this means that $$U_1 = U_2 \tag{4}$$

As in conformity with equation (3) the base-emitter voltage of the transistor 4 is an amount $U_d$ higher than the base-emitter voltage of the transistor 2, the following equation is found because of the exponential relationship between the emitter current and the base-emitter voltage:

$$I_4/I_1 = \exp(U_d/U_T) \tag{5}$$

where $I_4$ is the emitter current of the transistor 4 and $I_1$ is the emitter current of the transistor 1 and 2 respectively. From equations (2), (3) and (4) it follows that:

$$U_4 - U_3 = 2U_d \quad (6)$$

By equating the equations (1) and (6) it follows that:

$$U_d = 0.5U + \ln B \quad (7)$$

Insertion of equation (7) in equation (5) yields:

$$I_4/I_1 = \sqrt{B} \quad (8)$$

As the current $I_1$ is substantially equal to the current through terminal 5 (deviations are in the per-thousand range) and as the emitter current of the transistor $I_4$ is substantially identical to the current through the third terminal 7, this means that the current through the terminal 7 is a factor $\sqrt{B}$ larger than the current through the terminal 5.

For the above relationships it has been assumed that all the transistors are identical. However, it is also possible that only the transistors 1 and 3 are identical and have different emitter areas than the identical transistors 2 and 4, or that the transistors 3 and 4 are identical and have other current gain factors than the transistors 1 and 2. Finally, all four transistors may have mutually different emitter areas. In all these cases the factor $\sqrt{B}$ in equation (8) must be multiplied by a factor which depends on the effective emitter areas.

The input current can be applied to the terminal 5, the proportional current through the terminal 7 being further processed (the terminal 6 may then be connected, for example, to ground), but the current through terminal 6 may also be further processed because it corresponds at least substantially to the current $I_4$. Similarly, an input current may be applied to the terminal 6, the output current being taken from the terminal 5. In the last-mentioned case the output current is a factor $1/\sqrt{B}$ smaller than the input current.

FIG. 2 shows a preferred embodiment of the circuit arrangement in accordance with the invention used in conjunction with an amplitude demodulator. It has two branches, each comprising the series arrangement of the collector-emitter paths of two npn-transistors 11, 12 and 13, 14 respectively, connected to a direct current source 15. The transistor 11 is connected directly to the direct-current source constituted by the collector-emitter path of a transistor 15, but the emitter of the transistor 14 in the other branch is connected to the direct-current source via a resistor 16. Moreover, the base terminals of the transistors 11 and 14, whose emitters are connected to the direct current source 15 directly and via the resistors 16 respectively, are connected to the emitter of the transistors in the other branch. This means that the base of the transistor 14 is connected to the emitter of the transistor 12 and the base of the transistor 11 is connected to the emitter of the transistor 13.

The collector current of the transistor 13 is applied to an output resistor 17 via a pnp-transistor current-mirror whose output current is twice as large as the collector current of the transistor 13, the end of the output resistor which is remote from the current-mirror being connected to ground.

The inputs 18 and 19 of the arrangement are connected to the base terminals of the transistors 12 and 13 and to a signal source, not shown, which supplies the amplitude-modulated signals. If the base currents of the transistors are negligible, the transistor 13 will carry a collector current only if the potential on the input terminal 18 is positive relative to the potential on the input terminal 19. This results in a rectification, so that by means of a filter, not shown, which is coupled to the output resistor 17, it is possible to derive a direct voltage which may be used inter alia for control purposes.

However, since the base currents of the transistors 11 . . . 14 are not negligible and the current-gain factors of these transistors are finite, this means that in practice a quiescent current $I_r$ is superimposed on the useful signal component, which quiescent current depends on spreads between individual circuits and may adversely affect the control action.

This quiescent current depends on the direct current $I_o$ supplied by the direct current source 15 and the current gain factor B of the transistors 11 . . . 14 in conformity with the relationship:

$$I_r/I_o = A/\sqrt{B} \quad (9)$$

A is a factor which depends on the direct current $I_o$ and the value of the resistor R in accordance with the relationship:

$$A = \sqrt{U_T/RI_o} \quad (10)$$

For a value R of 60 ohms and a direct current $I_o$ of approximately 2 mA the factor A is approximately 0.5, so that after doubling of the quiescent current in the current-mirror 20 a quiescent current $I_r$ of a magnitude:

$$I_r = I_o\sqrt{B} \quad (11)$$

is applied to the output resistor. Consequently, $I_r$ is inversely proportional to the root of the current-gain factor and is therefore subject to spread between devices.

Almost this entire quiescent current cannot reach the resistor 17, because by means of the arrangement shown in FIG. 1, which together with the amplitude demodulator forms part of an integrated circuit, a direct current is subtracted which is substantially equal to and has the same dependence upon the current-gain factor as the quiescent current. For this purpose the arrangement shown in FIG. 1 has its terminal 6 connected to a current source 21 and its terminal 5 to the junction point between the output of the current-mirror 20 and the resistor 17. The current source 21 is constituted by the collector-emitter path of a transistor having the same characteristics as the transistor 15 and having its base-emitter path arranged in parallel with the base-emitter path of the transistor 15, so that it is connected to the same bias source 22 as the transistor 15. Consequently, the current $I_o$ is applied to the terminal 6, so that via the terminal 5 approximately the current $I_o/\sqrt{B}$ corresponding to the quiescent current component is drained. As a result of this, only the useful component which depends on the alternating voltage on the inputs 18, 19 flows through the resistor 17, which component is independent of device spreads and may therefore be used for control purposes.

The quiescent current (and the useful signal) need not be doubled by the current-mirror 20 if by changing the transistor geometry either the collector current of the transistor 21 is halved or the emitter current of the transistors 3 and 4 is doubled. The current-mirror arrangement comprising npn-transistors 1 . . . 4 may be constructed in a similar way be means of pnp-transistors.

What is claimed is:

1. A current-mirror arrangement comprising a first and a second branch connected in parallel with one another, two transistors each having a base-emitter path, wherein the first branch comprises two series-connected diodes and the second branch comprises a series arrangement of the base-emitter paths of the two transistors and with all of the emitter current of one transistor constituting the base current of the other transistor.

2. A current-mirror arrangement as claimed in claim 1, characterized in that an input current is applied to a junction point between the two branches, to which junction point an emitter of a transistor in the second branch is connected, and in that an output current is taken from an other junction point of the two branches.

3. A current-mirror arrangement as claimed in claim 1, characterized in that an input current is applied to a junction point which is connected to a base of a transistor in the second branch, and in that an output current is taken from an other junction point or from a collector of that transistor in the second branch whose emitter is connected to the other junction point.

4. A current-mirror arrangement as claimed in claim 3, characterized in that collectors of the two transistors of the second branch are interconnected.

5. A current-mirror comprising: first, second and third terminals, means connecting first and second diodes in series aiding configuration between said first and third terminals, first and second transistors each having a base-emitter path, means connecting the first transistor between the second and third terminals, means connecting the base-emitter path of the second transistor and the base-emitter path of the first transistor in a series circuit between the first and third terminals such that all of the emitter current of the second transistor flows into the base of the first transistor whereby the ratio between input and output currents of the current-mirror is proportional to the root of the current gain factor of at least one of said transistors.

6. A current-mirror as claimed in claim 5 wherein the input current is coupled to the third terminal and the output current is supplied from the first terminal.

7. A current-mirror as claimed in claim 5 wherein the input current is applied to the first terminal and the output current is supplied from the second or third terminal.

8. A current-mirror as claimed in claim 5 wherein a collector of the first transistor is directly connected to a collector of the second transistor.

9. A current-mirror as claimed in claim 8 wherein said first and second diodes comprise third and fourth diode connected transistors of the same type as the first and second transistors and the collectors of the first and second transistors are connected to said second terminal.

* * * * *